US009421568B1

(12) United States Patent
Reith

(10) Patent No.: US 9,421,568 B1
(45) Date of Patent: Aug. 23, 2016

(54) SPRAY GUN EXTENSION ADAPTER

(71) Applicant: Kevin Tetz, Columbia, TN (US)

(72) Inventor: David James Reith, Sarver, PA (US)

(73) Assignee: Kevin Tetz, Columbia, TN (US)

( * ) Notice: Subject to any disclaimer, the term of this patent is extended or adjusted under 35 U.S.C. 154(b) by 318 days.

(21) Appl. No.: 13/860,159

(22) Filed: Apr. 10, 2013

(51) Int. Cl.
*B05B 15/06* (2006.01)

(52) U.S. Cl.
CPC ..... *B05B 15/061* (2013.01)

(58) Field of Classification Search
CPC ..... B25G 1/04; B65D 83/201; B65D 83/202; B65D 83/203; B05B 11/3056; B05B 11/3057; B05B 15/061; B05B 3/087; B05B 7/0081; B05B 7/129; B05B 7/2478; B05B 9/0426; B05B 9/0894; B05B 12/008; B05B 12/1409; B05B 5/025–5/06; B05B 15/06
USPC ..... 239/153
See application file for complete search history.

(56) References Cited

U.S. PATENT DOCUMENTS

| | | | | |
|---|---|---|---|---|
| 1,849,511 | A * | 3/1932 | Thompson | 239/415 |
| 3,977,570 | A * | 8/1976 | Smrt | 222/174 |
| 4,023,711 | A * | 5/1977 | Sena | B05B 15/064 222/174 |
| 4,805,812 | A * | 2/1989 | Brody | B65D 83/22 222/402.11 |
| 5,518,148 | A * | 5/1996 | Smrt | 222/174 |
| 6,070,809 | A * | 6/2000 | Price | 239/273 |
| 6,547,165 | B2 * | 4/2003 | Goodwin et al. | 239/532 |
| 6,976,644 | B2 * | 12/2005 | Troudt | 239/587.1 |
| 7,040,510 | B1 * | 5/2006 | Hester | 222/174 |
| 7,637,882 | B2 * | 12/2009 | Carman et al. | 602/21 |
| 2006/0071036 | A1 * | 4/2006 | Gervais | 222/402.15 |

* cited by examiner

*Primary Examiner* — Arthur O Hall
*Assistant Examiner* — Juan C Barrera
(74) *Attorney, Agent, or Firm* — Mark J. Patterson; Garrett M. Hausman; Patterson Intellectual Property Law, P.C.

(57) ABSTRACT

A spray gun extension adapter allows a user to extend the reach of a spray gun. The adapter includes a mount shaped for receiving the spray gun. The adapter includes an adapter handle shaped to be gripped by a user. An adapter trigger is linked to an adapter actuator that operates the spray gun when the adapter trigger is engaged. The adapter actuator is positioned on the adapter to engage the spray gun trigger in some embodiments.

18 Claims, 5 Drawing Sheets

SPRAY GUN EXTENSION ADAPTER

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application which is hereby incorporated by reference: None.

BACKGROUND OF THE INVENTION

The present invention relates generally to devices for spraying materials and more particularly to adapters for handheld paint spray guns used, for example, to apply paint to motor vehicles.

Spray gun devices are generally known in the art for applying materials to surfaces. Spray guns typically include a nozzle or orifice from which a liquid, gas, or powdered material is ejected toward a substrate to be coated. Common applications of spray gun devices include spray guns for applying paint, varnish, sealant, lacquer, pigment, cleaners, abrasives, etc. Spray guns are used in a variety of industries, including in the automotive industry for painting vehicle components and in other industrial and agricultural applications.

Spray guns typically include one or more handles configured to be grasped by a user. The handle or handles are typically attached to a frame or body. A nozzle or orifice may also be attached to the frame or body of the spray gun. Spray guns typically also include an actuation mechanism such as a trigger or button for selectively releasing the material to be sprayed. Additionally, spray guns may include a container for storing the material to be sprayed. During use, a user will grasp the handle and engage the actuation mechanism to control the flow of spray material.

One problem associated with the use of spray guns is the limited reach of the spray gun device. Spray guns are usually dimensioned such that a user can lift and manipulate the gun. To achieve this goal, spray guns are usually of a size that can be easily handled by a user. When a user extends his or her arm while holding the spray gun, the range of spray coverage is generally limited by the distance the user can extend the arm. When the spray gun is extended to the user's maximum reach, the user must either move to a new position or move the substrate to further extend coverage with the spray gun.

Another problem associated with conventional spray guns is that they may be heavy. As a user holds a spray gun and extends the spray gun away from the user's body, a mechanical moment is created acting downwardly against the spray gun. This may cause the spray gun to inadvertently rotate in the user's hand. One example of the aforementioned problems is seen in the application of automobile paint spraying. When a user is painting an automobile or similar object using a handheld spray gun, such as an HVLP spray gun, the user must extend the user's arm to reach areas such as the center of a hood or top of the automobile. The area a user can spray may be limited by the user's reach. As such, users of handheld spray guns often struggle to extend the reach to cover large areas. This can cause the spray gun to tilt or rotate to a position that does not emit the sprayed material in a direction normal to the substrate surface. This is generally undesirable.

What is needed, then, are improvements in the devices and methods for extending the reach of a spray gun.

BRIEF SUMMARY OF THE INVENTION

The present invention provides a spray gun extension adapter. The adapter allows a user to extend the reach of a spray gun.

An object of the present invention is to provide a spray gun extension adapter having a mount shaped to receive a spray gun. The adapter also includes a handle spaced from the mount. An adapter trigger is positioned near the adapter handle. When a user engages the adapter trigger, an actuator on the adapter operates the spray gun to emit a spray of material. When a user releases the adapter trigger, the spray is terminated from the spray gun.

A further object of the present invention is to provide a spray gun extension adapter having a frame with a mount and an adapter handle. An adapter trigger is also disposed on the frame. The adapter trigger is linked to an adapter actuator. When the adapter trigger is engaged, the adapter actuator moves and operates the spray gun.

A further object of the present invention is to provide a method of extending the reach of a spray gun. The method includes the steps of providing an extension adapter having an adapter handle, an adapter trigger and an actuator; and mounting the spray gun on the adapter.

Yet another object of the present invention is to provide a spray gun extension adapter that is compatible with high velocity, low pressure (HVLP) spray guns.

Another object of the present invention is to provide a spray gun extension adapter with a mount that does not interfere with a hose fitting installed on the spray gun handle.

Numerous other objects, advantages and features of the present invention will be readily apparent to those of skill in the art upon a review of the following drawings and description of a preferred embodiment.

DETAILED DESCRIPTION OF THE INVENTION

Figure 1:
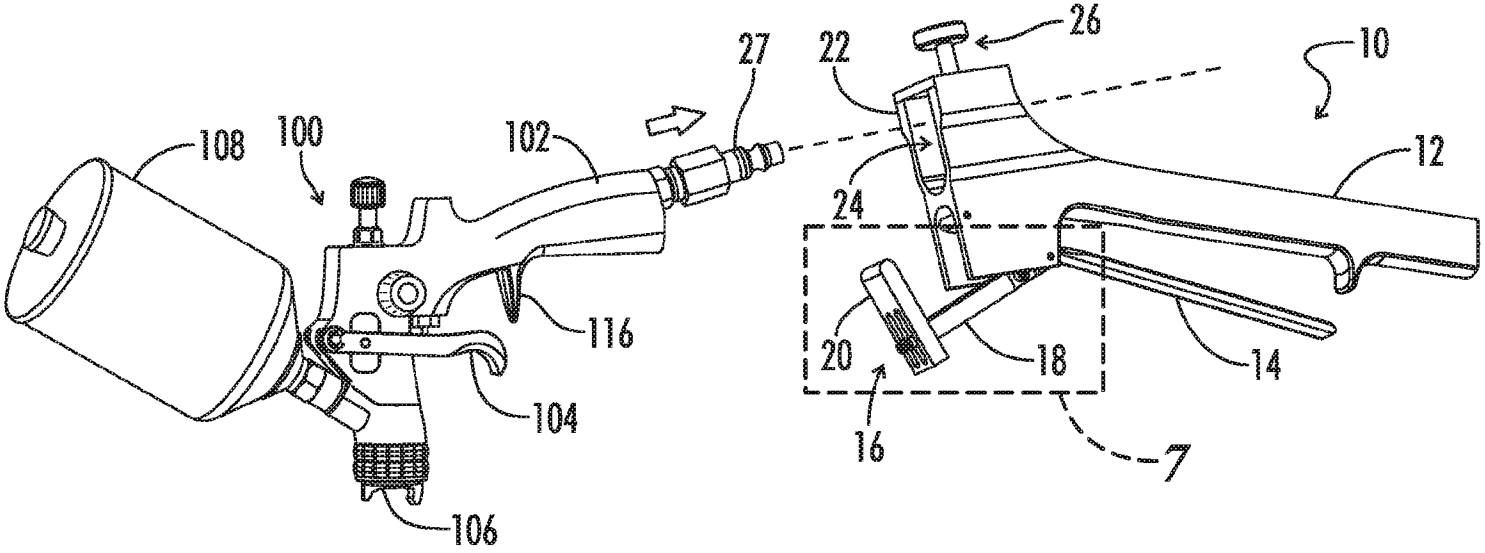
FIG. 1 illustrates a partially exploded perspective view of an embodiment of a spray gun and an adapter apparatus in accordance with the present invention.

Referring now to the drawings, various embodiments of the invention are illustrated. An embodiment of a spray gun adapter 10 positioned to receive a spray gun 100 is shown in FIG. 1. Spray gun 100 generally includes a spray gun handle 102 and a spray gun trigger 104. During use, a user or operator typically grasps the spray gun handle 102 and engages the spray gun trigger 104 to cause material to be sprayed from nozzle 106. Additionally, in some embodiments, spray gun 100 may include a tank 108 for storing the material to be sprayed. A finger guard, or spray gun trigger guard 116, may also be positioned on the spray gun 100 to prevent a user's finger from being pinched by spray gun trigger 104.

Spray gun adapter 10 includes an adapter handle 12 and a mount 22 in some embodiments. Spray gun 100 is generally attached to the spray gun adapter 10 at mount 22. Mount 22 can include any suitable structure or location on adapter 10 for attaching the spray gun 100 to adapter 10. As seen in one exemplary embodiment in FIG. 1, mount 22 includes a mount recess 24 having a recess geometry configured or adapted by shape, size and/or depth for receiving spray gun handle 102. Spray gun handle 102 slides into mount recess 24, and a clamp 26 on adapter 10 may be used to secure the spray gun handle 102 in the mount recess 24. In some embodiments, clamp 26 includes a threaded post that may be tightened against the spray gun 100 to secure the spray gun 100 to the adapter 10. Clamp 26 can include other suitable clamping structures in various other embodiments.

Figure 2:
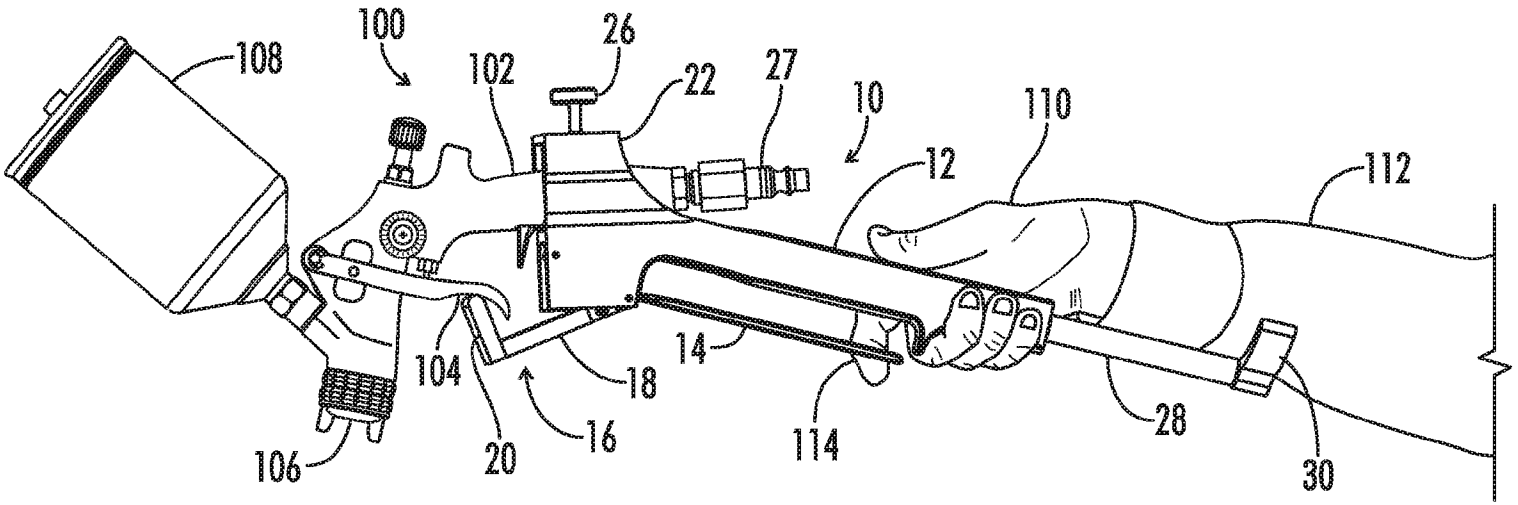
FIG. 2 illustrates a perspective view of an embodiment of a spray gun adapter and spray gun held in a user's hand.

Mount recess 24 includes front and rear openings to allow passage of a pressurized gas line to be coupled to the handle on spray gun 100. For example, as seen in FIG. 2, in some embodiments, when spray gun handle 102 is installed in mount recess 24 on adapter 10, a gas fitting on spray gun handle 102 may extend from mount 22 allowing ease of attachment or disconnection with a pressurized gas line from a compressor. Embodiments may include a supply line 27 (which may be at least one of the gas fitting and the pressurized gas line described above) extending away from the adapter handle 12 when the spray gun handle 102 is installed in the mount recess 24 on the adapter 10.

Also seen in FIG. 1, adapter 10 includes an adapter trigger 14. Adapter trigger 14 is linked either directly or indirectly to an adapter actuator 16 on adapter 10. Adapter actuator 16 is positioned to engage spray gun trigger 104 when spray gun 100 is installed on adapter 10, as seen in FIG. 2. When a user engages adapter trigger 14, adapter actuator 16 is configured to operate spray gun 100 by engaging spray gun trigger 104. Thus, a user may operate spray gun 100 without directly engaging the spray gun trigger 104. For example, as seen in FIG. 2, a user may grip adapter 10 at the adapter handle 12. Adapter trigger 14 may be engaged by one or more user fingers 114. When the adapter trigger 14 is engaged, a mechanical linkage causes movement of adapter actuator 16, thereby operating the spray gun 100. By selectively engaging and releasing the adapter trigger 14, a user may control the spray emitted from the spray nozzle 106 on spray gun 100. Spray gun trigger 104 is thus selectively engageable, as a user may engage the adapter trigger 14 to spray material and then release the adapter trigger 14 to stop spraying material.

Figure 3:
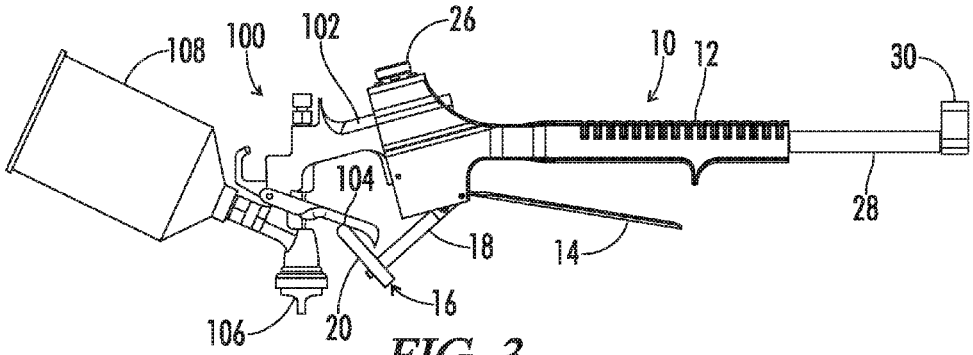
FIG. 3 illustrates a side elevation view of an embodiment of a spray gun adapter and spray gun.
Figure 4:
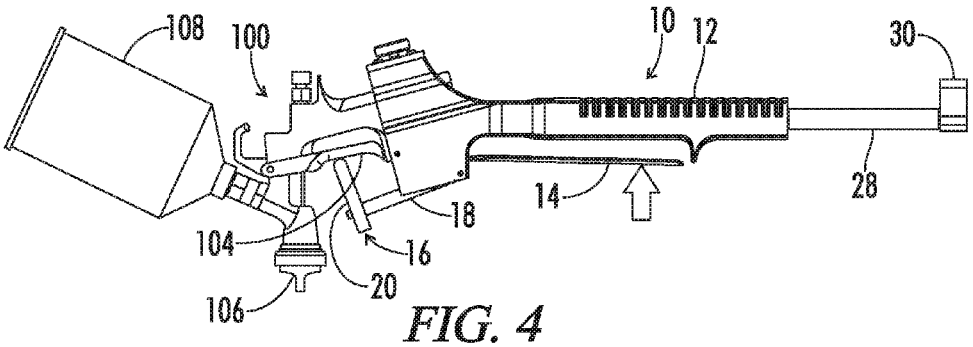
FIG. 4 illustrates a side elevation view of the embodiment of a spray gun adapter and spray gun of FIG. 3 with the adapter trigger in an engaged position.

Referring to FIG. 3 and FIG. 4, an embodiment of a spray gun adapter 10 with a spray gun 100 mounted thereto is shown. Adapter 10 in FIG. 3 is shown with adapter trigger 14 in an unengaged position. In this position, adapter actuator 16 is not depressing spray gun trigger 104 enough to cause material to be emitted from nozzle 106. In FIG. 4, adapter trigger 14 is shown in an engaged position. In this position, spray gun trigger 104 is pushed toward spray gun handle 102 by actuator 16. This causes material to be sprayed from nozzle 106. In some applications, the amount of material emitted from nozzle 106 may be controlled by the displacement of adapter trigger 14. When adapter trigger 14 is only slightly depressed or engaged, a small amount of material may be sprayed from nozzle 106. However, as adapter trigger 14 becomes more fully engaged, or depressed toward adapter handle 12, a greater volume of material may be sprayed from nozzle 106.

Figure 5:
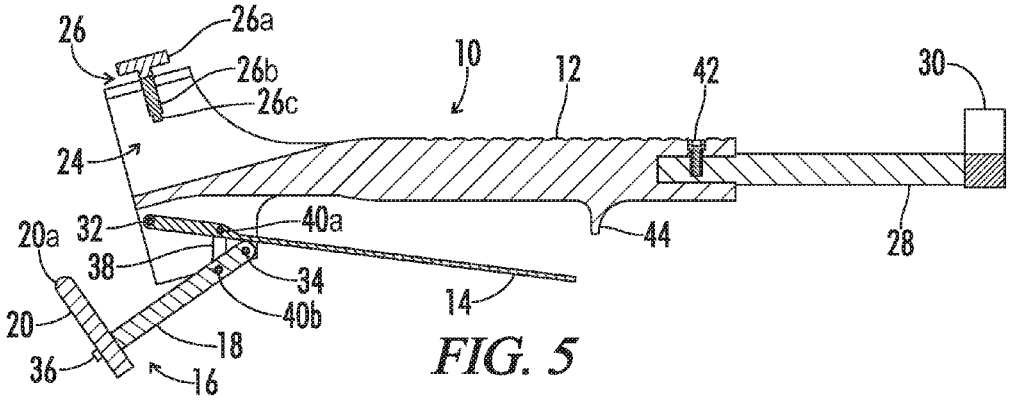
FIG. 5 illustrates a partial cross-sectional view of an embodiment of a spray gun adapter.
Figure 6:
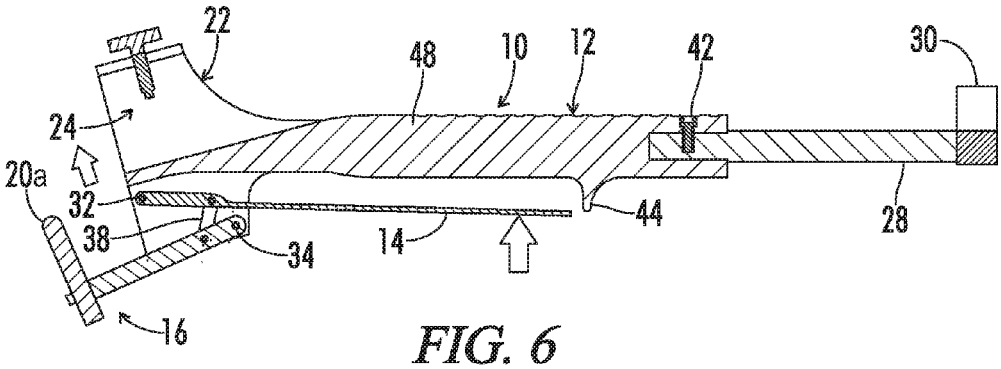
FIG. 6 illustrates a partial cross-sectional view of an embodiment of a spray gun adapter.

Referring further to FIGS. 1-6, in some embodiments, adapter actuator 16 includes an actuator arm 18 and an actuator head 20. Actuator head 20 includes a distal head end 20*a*, seen in FIG. 5 and FIG. 6. Distal head end 20*a* on actuator head 20 forms the portion of adapter actuator 16 that is operable to engage spray gun trigger 104 in some embodiments. Adapter actuator 16 is linked to adapter trigger 14 in a mechanical linkage. Forced movement of adapter trigger 14 generally causes a corresponding movement in adapter actuator 16. As seen in FIG. 5 and FIG. 6, in some embodiments, adapter trigger 14 is coupled to actuator 16 using a linkage member 38. Thus, as seen in FIG. 6, when adapter trigger 14 is engaged, or pressed toward adapter handle 12, linkage member 38 pulls upwardly on actuator arm 18 and causes actuator head 20 to move upwardly generally toward the spray gun trigger 104. As such, adapter trigger 14, linkage member 38, and actuator 16 form a four-bar linkage, or four-bar mechanism. In some alternative embodiments, actuator 16 is integrally formed as part of adapter trigger 14 in a unitary construction. As such, forced movement of adapter trigger 14 causes a corresponding movement of adapter actuator 16 for operating the spray gun.

Adapter 10 includes a frame 48 in some applications. Frame 48 includes a handle 12 and a mount 22 disposed on the frame. Frame 48 provides a longitudinal extension for extending the reach of a spray gun when the spray gun is installed on the mount 22. A user may grasp handle 12, as seen in FIG. 2. Adapter trigger 14 is pivotally attached to frame 48 at a trigger pivot 32. Additionally, adapter actuator 16 may be pivotally attached to frame 48 at an actuator pivot 34 in some embodiments. Linkage member 38 is also pivotally attached to adapter trigger 14 at a first linkage pivot 40*a*, and linkage member 38 is also pivotally attached to adapter actuator 16 at a second linkage pivot 40*b* in some embodiments.

Figure 7:
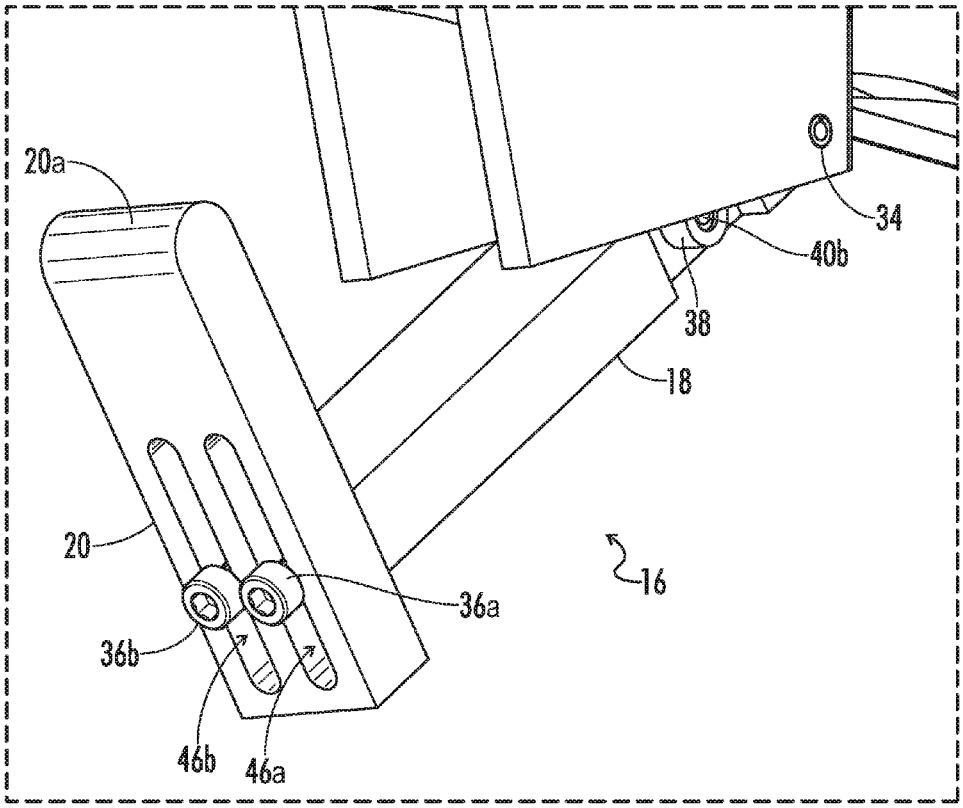
FIG. 7 illustrates a detail perspective view of an embodiment of an actuator on a spray gun adapter.

Referring further to FIG. 1 and FIG. 7, in some embodiments, adapter actuator 16 includes an actuator arm 18 and an actuator head 20. Actuator arm 18 is pivotally attached to frame 48 at actuator pivot 34. Actuator head 20 may be adjustable to accommodate different spray guns. Adjustability of actuator head relative to actuator arm allows adapter 10 to be used interchangeably with different spray guns that may have different spray gun trigger geometries. For example, as seen in FIG. 7, actuator head 20 is moveable relative to actuator arm 18. In some embodiments, actuator head 20 includes one or more travel slots such as first and second travel slots 46*a*, 46*b*. Actuator head 20 may be attached to actuator arm 18 via a plurality of head fasteners 36. A first head fastener 36*a* is disposed in first travel slot, and a second head fastener 36*b* is disposed in second travel slot. Each head fastener secures actuator head 20 to actuator arm 18. Actuator head 20 may be moved longitudinally relative to actuator arm 18, and then first and second head fasteners 36*a*, 36*b* may be tightened against actuator head 20 to fix actuator head in place relative to actuator arm 18. Although adapter actuator 16 is shown in FIG. 7 with travel slots and fasteners, various other suitable mechanical configurations for providing adjustability to actuator head may be utilized.

As seen in FIG. 5 and FIG. 6, in some embodiments, adapter 10 includes an adapter trigger guard 44 protruding downwardly from adapter handle 12. Adapter trigger guard 44 provides a longitudinal reference point for a user to grasp adapter handle 12, as seen in FIG. 2. A user may grasp adapter handle 12 adjacent trigger guard 44 such that none of the user's fingers become trapped or pinched between the underside of adapter trigger 14 and adapter handle 12.

Referring further to FIG. 5, in some embodiments, clamp 26 includes a clamp knob 26*a* attached to a threaded clamp post 26*b*. A user may manually turn clamp knob 26*a* to tighten clamp distal end 26*c* against spray gun 100. Additionally, in some embodiments, mount 22 is shaped to receive the handle of spray gun 22 such that the spray gun trigger guard 116 provides a longitudinal stop when spray gun handle 102 is inserted into mount recess 24, as seen in FIG. 1 and FIG. 2.

Referring again to FIG. 2, in some embodiments, adapter 10 includes an arm support 28 protruding from adapter handle 12 on adapter 10. Arm support 28 includes a longitudinal extension protruding toward a user's forearm 112 when the user is grasping adapter handle 12. Arm support 28 may include a longitudinal rod attached to adapter handle 12 on adapter 10. In some embodiments, arm support 28 is removable, or detachable, from adapter 10 via one or more arm support fasteners 42, seen in FIG. 5. For example, a user may choose to operate adapter 10 without arm support 28. Additionally, a detachable arm support 28 allows adapter 10 to attain a lower profile for storage, use, or shipment. Also seen in FIG. 2, in some embodiments, an arm brace 30 is disposed on the arm support 28. Arm brace 30 may have a curved profile to correspond to a user's forearm 112 in some embodiments. In some embodiments, arm brace 28 is telescoping and may be longitudinally adjustable to fit different users.

As seen in FIG. 2, attachment of spray gun 100 to mount 22 on adapter 10 extends the reach of the spray gun nozzle 106 away from the user's hand 110. This allows a user to cover more area with spray gun 100. Additionally, the user's hand 110 may serve as fulcrum between adapter handle 12 and arm support 28. As such, the weight of spray gun 100 is counterbalanced by the engagement of arm support 28 and arm brace 30 with the user's forearm 112. This makes it easier for a user to operate spray gun 100 and reduces user fatigue in some applications.

Adapter 10 may be constructed of any suitable material, such as polymers, plastics, metals, composites, etc. In some embodiments, adapter 10 is made of machined metal such as aluminum for reduced weight.

In further embodiments, the present invention provides a method of extending the reach of a spray gun. The method includes the steps of: (a) providing a spray gun extension adapter having a handle, an adapter trigger and an adapter actuator; and (b) mounting the spray gun on the adapter.

Thus, although there have been described particular embodiments of the present invention of a new and useful Spray Gun Extension Adapter apparatus, it is not intended that such references be construed as limitations upon the scope of this invention except as set forth in the following claims.

What is claimed is:

1. An extension adapter apparatus for use with a spray gun, comprising:
- an adapter handle;
- a mount configured to receive the spray gun;
- a selectively engageable adapter trigger; and
- an adapter actuator linked to the adapter trigger, the adapter actuator including an actuator arm and an actuator head,
- wherein the actuator head is slidably adjustable relative to the actuator arm, and
- wherein the adapter actuator is positioned to operate the spray gun when the adapter trigger is engaged.

2. The apparatus of claim 1, further comprising a linkage connecting the adapter trigger to the adapter actuator.

3. The apparatus of claim 1, further comprising a clamp disposed on the mount.

4. The apparatus of claim 1, further comprising an arm support extending from the adapter handle.

5. The apparatus of claim 4, further comprising an arm brace disposed on the arm support.

6. The apparatus of claim 1, further comprising a mounting recess defined on the mount.

7. An adapter apparatus for extending the reach of a spray gun, comprising:
- a frame including a handle end and a mount end, the handle end opposite the mount end;
- an adapter handle disposed nearer the handle end than the mount end of the frame;
- a mount disposed nearer the mount end than the handle end of the frame, the mount having a geometry configured to receive the spray gun;
- a selectively engageable adapter trigger pivotally attached to the frame nearer the mount end than the handle end;
- an adapter actuator disposed nearer the mount end than the handle end of the frame; and
- wherein the adapter actuator is configured to operate a spray gun trigger when the adapter trigger is engaged.

8. The apparatus of claim 7, wherein the adapter actuator is pivotally attached to the frame at an actuator pivot.

9. The apparatus of claim 8, further comprising a linkage member connecting the adapter trigger to the adapter actuator.

10. The apparatus of claim 9, wherein the frame, adapter actuator, adapter trigger, and linkage member form a four-bar linkage.

11. The apparatus of claim 7, further comprising a clamp disposed on the frame.

12. The apparatus of claim 7, further comprising an arm support extending from the frame.

13. The apparatus of claim 12, wherein the arm support is detachable.

14. The apparatus of claim 7, further comprising an adapter trigger guard protruding from the adapter handle.

15. The apparatus of claim 7, wherein the adapter actuator comprises an actuator arm and an actuator head.

16. The apparatus of claim 15, wherein the actuator head is adjustable relative to the actuator arm.

17. The apparatus of claim 16, wherein the actuator arm is pivotally attached to the frame.

18. An adapter apparatus for extending the reach of a pneumatic spray gun including a pneumatic spray gun handle and a supply line, comprising:
- a frame;
- an adapter handle disposed on the frame;
- an adapter trigger disposed on the frame;
- an adapter actuator disposed on the frame, the adapter actuator actuated when the adapter trigger is engaged;
- a mount disposed on the frame, the mount defining a hole configured to receive the pneumatic spray gun handle;
- wherein an axis of the hole is angled relative to the adapter handle to direct the supply line away from the adapter handle; and
- wherein the mount is configured to nonadiustably maintain the axis of the hole at only a single fixed angle relative to the adapter handle.

* * * * *